US005970766A

United States Patent [19]

Sosa-Razón et al.

[11] Patent Number: 5,970,766

[45] Date of Patent: Oct. 26, 1999

[54] BENDING MACHINE FOR CLOSING CHANNELS

[75] Inventors: Tiburcio Sosa-Razón; Ramiro Montero-Cantu, both of Monterrey N. L., Mexico

[73] Assignee: Metalsa S de R.L., Apodaca, N.L., Mexico

[21] Appl. No.: 09/064,753

[22] Filed: Apr. 22, 1998

[51] Int. Cl.[6] ..... B21D 5/04

[52] U.S. Cl. ..... 72/20.5; 72/20.1; 72/312; 72/315; 72/294

[58] Field of Search ..... 72/312–315, 386, 72/384, 383, 399, 452.9, 20.3, 20.1, 20.2, 20.5, 294

[56] References Cited

U.S. PATENT DOCUMENTS

| | | | |
|---|---|---|---|
| 4,798,073 | 1/1989 | Dischler | 72/218 |
| 4,890,469 | 1/1990 | Dischler | 72/218 |
| 5,231,907 | 8/1993 | Matsuoka | 72/313 |

FOREIGN PATENT DOCUMENTS

| | | | |
|---|---|---|---|
| 163530 | 9/1983 | Japan | 72/313 |
| 227926 | 11/1983 | Japan | 72/389.1 |
| 3827 | 1/1987 | Japan | 72/313 |
| 199231 | 9/1987 | Japan | 72/452.9 |
| 263824 | 11/1987 | Japan | 72/313 |
| 275222 | 12/1991 | Japan | 72/315 |
| 1402386 | 6/1988 | U.S.S.R. | 72/452.9 |

*Primary Examiner*—Daniel C. Crane
*Attorney, Agent, or Firm*—Abelman, Frayne & Schwab

[57] ABSTRACT

A bending machine for closing channels which simultaneously bends both side walls of a "U" shaped metal channel, comprising: a support frame; a lower male member slide mounted on the support frame, having a normally closed two-halves male member, each half having a notch in lateral wall thereof, and is associated with driving means for opening the halves of the male member when receiving a channel and for releasing the channel once its side walls thereof have been bent inside each notch, allowing to remove it therefrom; and two lateral bending inserts each slide mounted on the support frame, and associated with driving means, for bending both side walls of the channel into the notches. If desired an upper member, mounted on lowering and lifting means, is provided, having a blank holder to retain a channel on the lower male member when it is closed and/or a die member for simultaneously bend a plate forming a channel, and then close both side walls thereof forming a closed channel.

13 Claims, 2 Drawing Sheets

BENDING MACHINE FOR CLOSING CHANNELS

BACKGROUND OF THE INVENTION

A. Field of the Invention

The present invention relates to bending machines and more particularly to a channel bending machine which simultaneously bends both side walls of a "U" shaped metal channel.

B. Description of the Related Art

There is a number of well known bending machines for metal pieces such as wires, plates, etc., of the type wherein the metal piece is firstly bent by pressing such piece by means of a pressing member against a support member having a predetermined pattern.

With this type of machines a great variety of metal pieces can be manufactured, including channel shaped pieces of the type wherein a large metal plate is bent by its longitudinal edges usually at about 90°, which are used for multiple purposes such as in the automotive industry for the manufacturing of truck chassis or automotive chassis.

Sometimes, for some specific applications, the channel shaped piece have to be additionally bent by one or both side walls of the channel in order to give them for example a special "closed" channel shape, which is very difficult to carry out with the actual machines, because of the fact that the piece is already formed as a channel and is very difficult to adapt it at the actual components of the machines, firstly by one side and then by the other side.

One bending machine for forming "U" pieces such as rounded bars, channels, sections and the like, is disclosed in US. Pat. Nos. 4,798,073 and 4,890,469 both of Dischler, which comprises two opposed spaced bending devices, each including at least two bending components and drive means to move at least one of the bending components essentially transversely to the length of the piece to be bend.

To produce a rounded "U" shaped piece, the piece to be bent is placed between the bending components of each of the bending devices and then, a bending moment is applied by the bending components of two of the bending devices, acting transversely to the longitudinal axis of the piece. Due to the application of such bending torque the piece is bent in a rounded "U" shape piece.

Such machine, cannot produce pieces with side walls at 90° and it is not possible to close the sides of the rounded "U" shaped piece or a channel in the same machine.

In the known art, although highly desirable, there is no machine which simultaneously could bend the plate as a "U" shaped channel, and then close the side walls thereof, mainly because there were no components to close the sides of the "U" shaped channel and there was no possibility to remove the closed channel from the support parts of the machine.

In other words, there is no machine available which be capable of simultaneously bend a metal plate as a "U" shaped channel, and then close one or both side walls thereof in a single machine in a single operation, mainly because there was no possibility to remove a closed channel from a support piece of the machine.

Considering the above referred problems, applicants developed a bending machine which simultaneously can bend both side walls of a "U" shaped channel to close one or the two side walls thereof, comprising: a support frame; a lower male member slide mounted on the support frame, having a two-halves male member, each half having a notch in lateral wall thereof, and is associated with driving means for opening the normally closed two halves of the male member when receiving a channel and releasing the channel once its side walls thereof have been closed inside each notch, allowing to remove it therefrom; and two lateral bending inserts each slide mounted on the support frame, and associated with driving means, for bending both side walls the channel into the notches. If desired an upper member, mounted on lowering and lifting means, is provided, having a blank holder to retain a channel on the lower male member when it is closed and/or a die member for simultaneously bend a plate forming a channel, and then close both side walls thereof forming a closed channel.

The bending machine of the present invention also can be combined with a channel forming machine in order to form a channel and then bending the sides of the channel.

SUMMARY OF THE INVENTION

It is therefore a main object of the present invention to provide a bending machine for closing channels which allows to simultaneously close both side walls of a "U" shaped channel.

It is another object of the present invention to provide a bending machine for closing channels, of the above disclosed nature, which allows to remove the closed channel from the machine.

It is a further object of the present invention to provide a bending machine for closing channels, of the above disclosed nature, which can be combined with a "U" shaped channel forming machine in order to form a channel and then closing both side walls of the channel.

These and other objects and advantages of the bending machine for closing channels, of the present invention will become apparent to those persons having an ordinary skill in the art, from the following detailed description of the embodiments of the invention which will be made with reference to the accompanying drawings.

DETAILED DESCRIPTION OF THE INVENTION

The channel bending machine for closing channels, which simultaneously bends both side walls of a "U" shaped metal channel, of the present invention, will be now firstly described in accordance with its most general embodiment thereof, comprising:

a support frame having a first and a second end;

a lower male member slide mounted on the support frame, having a normally closed two-halves male member, each of the halves having a notch in lateral wall thereof;

driving means associated with each of the halves of the lower male member for opening them when receiving a channel and then closing them releasing the channel once the side walls thereof have been closed inside each notch, allowing to remove it therefrom;

two lateral bending inserts each slide mounted on an end of the support frame;

driving means associated with each of the bending inserts, for pushing the bending inserts, bending both side walls of the channel into the notches and retracting the bending inserts once the side walls of the channel have been closed.

Figure 1:
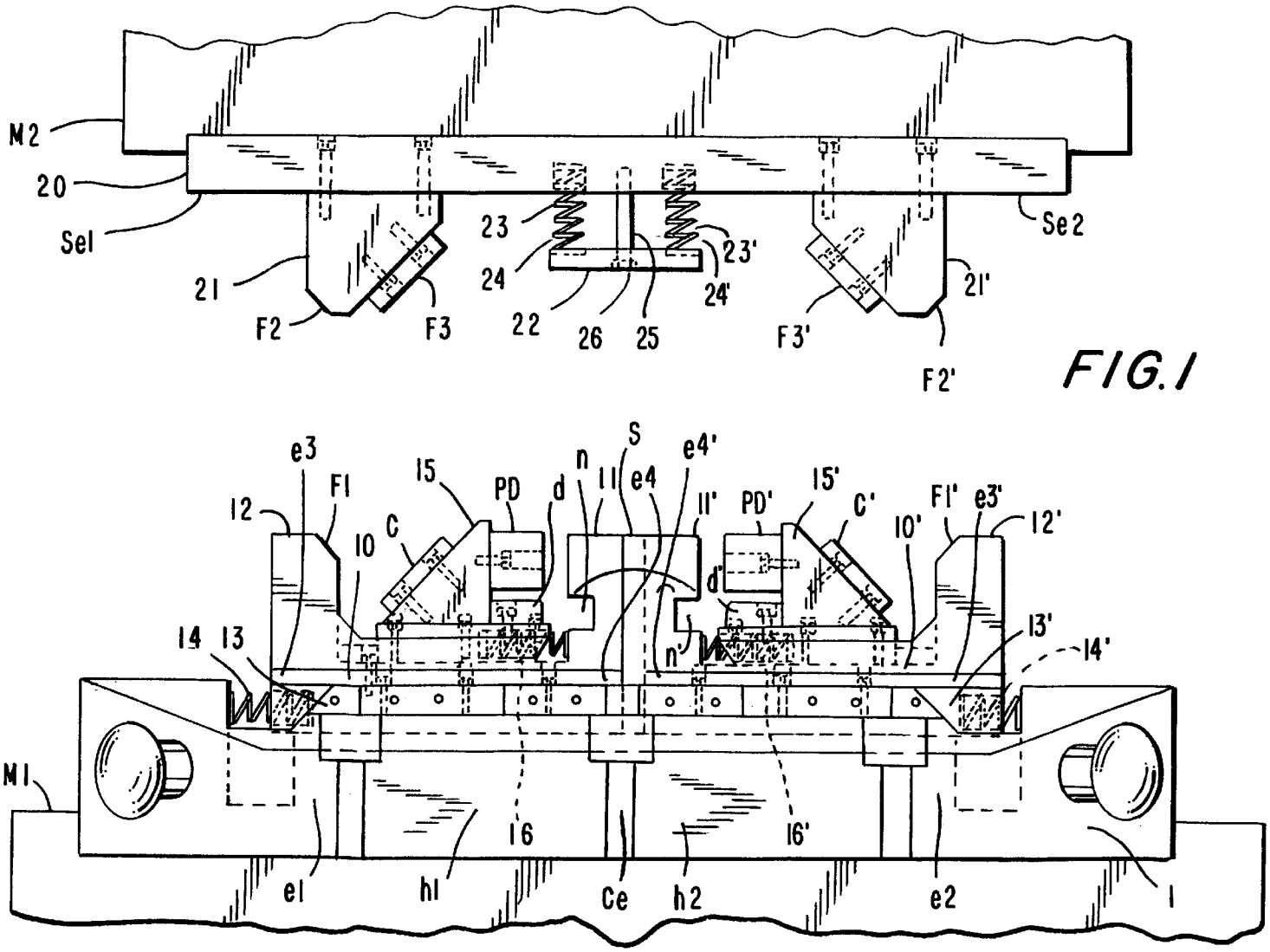
FIG. 1 is a front view of a first embodiment of the channel bending machine of the present invention.

Now, referring to FIG. 1, the channel bending machine, in accordance with a preferred embodiment of the present invention, wherein the driving means of the male member and of the bending inserts comprise cam means, comprising:

a lower member M1, including:

a support frame 1 having a first half portion h1 and a second half portion h2, each starting from the central portion Ce toward a first side end e1 and a second side end e2;

a first sliding platform 10, and a second sliding platform 10', each of which is slide mounted on a half portion of the support frame 1, and can be slipped on the support frame from the central portion Ce to the ends e1,e2 thereof, each of said platforms having a first end e3,e3' and a second end e4,e4', the second end e4 of the first platform 10 being oriented to the central portion Ce of the support frame 1 into contact with the second end e4' of the second platform 10', and its first end e3,e3' being oriented to one end e1,e2 of the support frame 1;

two male members 11,11', both forming an upper channel receiving surface S, and each of which is coupled on the second end e4,e4' of each platform 10,10' into contact with each other, and having a notch n,n' at a central height thereof, oriented to the ends e1,e2 of the support frame 1, at a height corresponding to the desired length of the side walls of the channel to be closed;

two cam members 12,12', each coupled on the first end e3, e3' of each platform 10,10', and having a sloped cam surface f1,f1' oriented to the central portion Ce of the support frame;

two bump elements 13,13' each coupled to a lower surface of the first end e3,e3' of each platform 10,10' and spaced from an end of the support frame 1 by a spring 14,14' which pushes the platforms 10,10' and the male members 11,11' to keep them normally closed';

two close bending inserts 15,15', each centrally and slide mounted on the upper surface of the sliding platform 10,10', and is separated from the male member 11,11' by a spring 16,16' which pushes the close bending inserts 15,15' to keep them normally spaced form each male member 11,11', and having a sloped cam surface c,c' oriented to the ends e1,e2 of the support frame 1, a die d,d' oriented to the notch n,n' of each male member 11,11', and a compressible pad PD, PD' over the die d,d'; and an upper member M2, mounted on a lowering and lifting mechanism (not illustrated), actuating on the lower member M1, and including:

a support frame 20 having a first end se1 and a second end se2;

two cam members 21,21', each retained at each end se1,se2 of the support frame 20, into alignment with the cam members 12,12' of the lower member M1, and having a first cam sloped surface f2, f2' which cooperates with the cam sloped surfaces f1, f1' of the cam members 12, 12' of the sliding platforms 10,10' of the lower member M1, pulling the sliding platforms 10, 10', to the ends e1, e2 of the support frame 10, 10' opening the sliding platforms 10,10', separating the male members 11,11' from each other, and a second cam slop surface f3,f3' cooperating with the cam slope surfaces c,c' of the bending inserts 15,15', pushing them against the male members 11,11' and therefore causing that the die d,d' of the bending inserts 15, 15' penetrate into the notch n,n' of the male members 11, 11' in order to close a channel side placed between them; and a blank holder 22, resiliently retained at the middle portion of the support frame 20, by means of two lateral guide members 23,23' and surrounding springs 24,24' for pressing the channel against the channel receiving surface S in order to avoid any movement of the channel when it is closed, and a central retaining bar 25 passing trough a hole 26 of the retaining platform 22 for laterally retain the channel.

Figure 2:
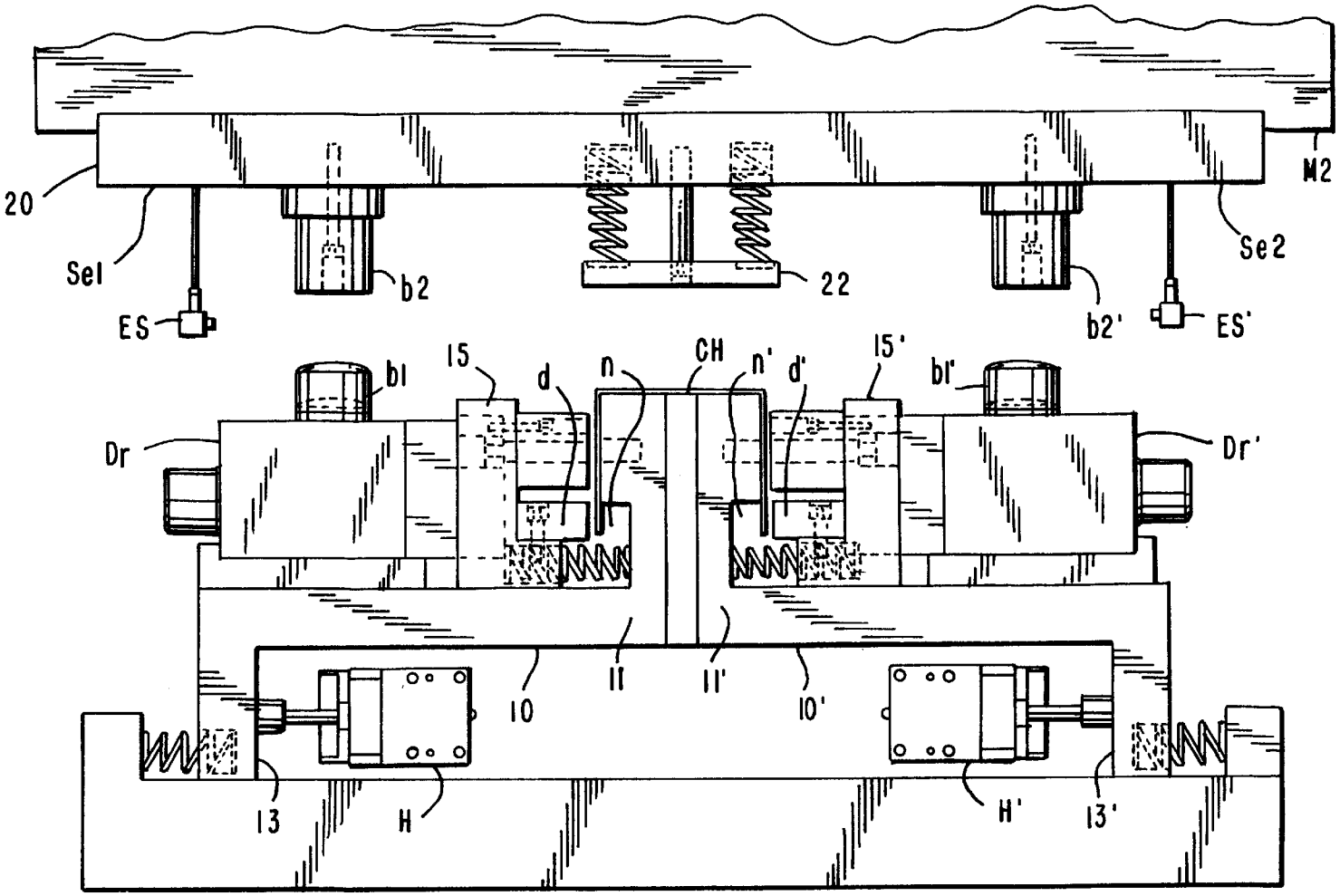
FIG. 2, is a front view of a second embodiment of the channel bending machine of the present invention.

In the second embodiment of the channel bending machine of the present invention, shown in FIG. 2, the sliding platforms 10, 10' including the normally closed male members 11,11' are driven by two hydraulic piston and cylinder assemblies H, H', actuating on the bump elements 13, 13', opening of the sliding platforms 10,10' and separating the male members 11,11' from each other; also, each of the close bending inserts 15,15' has drive means Dr, Dr' which can be an hydraulic piston and cylinder assembly or electric motors, linked to the ends of each sliding platform 10,10', pushing the bending inserts against the male members 11,11' and therefore causing that the die d,d' of the bending inserts 15, 15' penetrate into the notch n,n' of the male members 11, 11' in order to close a channel side placed between them. There are also included punching means pM1, pM2 linked to the close bending inserts in order to punch both side walls of the channel or to the upper member M2 to punch the web of the channel. Two sensors ES, ES' each retained at each end se1, se2 of the support frame 20 of the upper member M2 to detect when two bump elements b1,b1' each mounted on the slide platforms 10,10', are in alignment and in contact with another pair of bump elements b2,b2' retained at the support frame 20 in order to assure that the sliding platforms 10,10' are opened (and thus the male members 11,11') and that the retaining platform 22 is in contact with a channel CH, and provide a signal to control means (not shown), such as a data processor which activates the hydraulic piston and cylinder assemblies H, H' and then the hydraulic piston and cylinder assembly or electric motors Dr, Dr'.

Finally it must be understood that the bending machine for closing channels, of the present invention, is not limited exclusively to the embodiments above described and illustrated and that the persons having ordinary skill in the art can, with the teaching provided by the invention, to make modifications to the design and component distribution of the bending machine of the present invention, which will clearly be within of the true inventive concept and of the scope of the invention which is claimed in the following claims:

We claim:

1. A bending machine for closing channels which simultaneously bends both side walls of a "U" shaped metal channel, comprising:

a support frame comprised of two half portions;

two sliding platforms, each of which is slide mounted on a half portion of said two half portions of the support frame;

a lower male member mounted on each of said two sliding platforms, each of the lower male members having a notch in lateral wall thereof;

driving means associated with each lower male member for causing each lower male member to move away from contact with the other lower male member when receiving a channel and causing each lower male member to move into contact with the other lower male member releasing the channel once the side walls thereof have been closed inside each notch, allowing the removal of the channel therefrom;

two lateral bending inserts each slide mounted on one of said two sliding platforms;

driving means associated with each of the bending inserts, for pushing the bending inserts bending both side walls of the channel into the notches and retracting the bending inserts once the side walls of the channel have been closed; and sensor means associated with an upper male member, to provide signals representative of the alignment of bump means provided at the upper male member and with the drive means associated with the bending inserts, and control means receiving the signals provided by the sensor means, in order to activate the driving means associated with each of the lower male members and the bending inserts.

2. The bending machine as claimed in claim 1 including an upper retaining member, mounted on lowering and lifting means, to retain a channel on the lower male member to be closed.

3. The bending machine as claimed in claim 1, including an upper female member, mounted on lowering and lifting means, for simultaneously bend a plate forming a channel, and retain the channel to close both side walls thereof forming a closed channel.

4. The bending machine as claimed in claim 1 wherein the driving means associated with each lower male member and the closing bending inserts, comprising: cam means coupled to the sliding means associated with the male members; cam means coupled to the close bending inserts; and cam means retained by the upper male member mounted on lowering and lifting means actuating on the cam means associated with the male members and the closing bending inserts.

5. The bending machine as claimed in claim 1 wherein the driving means associated with each lower male member and the closing bending inserts comprises pneumatic motors.

6. The bending machine as claimed in claim 1 wherein the driving means associated with each lower male member and the closing bending inserts comprises electric motors.

7. The bending machine as claimed in claim 1 wherein the driving means associated with each lower male member and the closing bending inserts comprises hydraulic motors.

8. The bending machine as claimed in claim 1 wherein a cam means associated with the male member includes a sloped surface oriented to a central portion of the male member, and a cam means of the bending inserts includes a sloped surface oriented to the ends of the support frame.

9. The bending machine as claimed in claim 1 wherein a cam means mounted on the upper male member, has a first cam sloped surface cooperating with the sloped surfaces of cam members of the lower male member, causing the lower male members to move away from contact with each other and a second cam sloped surface cooperating with a sloped surface of the bending inserts, to push them bending the side walls of the channel.

10. The bending machine as claimed in claim 1 wherein the lower male members are normally held in contact by means of springs abutting against ends of the support frame and each male member, and each bending insert is kept normally separated by means of a spring abutting against each male member and an end of each bending insert.

11. The machine as claimed in claim 1, wherein the support frame of the lower member includes punching means in order to punch the sides of a channel.

12. The machine as claimed in claim 1, wherein the support frame of the lower member includes punching means in order to punch the sides of a channel.

13. The bending machine as claimed in claim 1, including upper punching means, mounted on lowering and lifting means, for punching the web of a channel.

* * * * *